US007806473B1

(12) United States Patent
Faiks

(10) Patent No.: US 7,806,473 B1
(45) Date of Patent: Oct. 5, 2010

(54) STACKABLE CHAIR AND FRAMEWORK THEREFOR

(76) Inventor: Frederick S. Faiks, 3692 Fenwick Rd., Greenville, MI (US) 48838

( * ) Notice: Subject to any disclaimer, the term of this patent is extended or adjusted under 35 U.S.C. 154(b) by 754 days.

(21) Appl. No.: 11/284,253

(22) Filed: Nov. 21, 2005

(51) Int. Cl.
*A47C 3/04* (2006.01)
*A47C 7/02* (2006.01)
*A47C 7/00* (2006.01)

(52) U.S. Cl. ..... 297/239; 297/452.18; 297/440.11; 297/452.12; 297/452.14

(58) Field of Classification Search ..... 297/452.18, 297/440.11, 451.9, 239, 229
See application file for complete search history.

(56) References Cited

U.S. PATENT DOCUMENTS 604,212 A * 5/1898 Palmer ..... 297/440.11
2,642,118 A * 6/1953 Lamb ..... 297/239
2,670,787 A * 3/1954 Vandas et al. ..... 297/411.41
3,275,371 A 9/1966 Rowland
3,278,227 A 10/1966 Rowland
3,365,233 A 1/1968 Uyeda et al.
3,404,916 A 10/1968 Rowland
3,446,530 A 5/1969 Rowland
3,677,601 A * 7/1972 Morrison et al. ..... 297/440.11
3,695,702 A * 10/1972 Ingellis ..... 297/440.24
3,746,394 A * 7/1973 Speidel ..... 297/452.14
3,847,433 A 11/1974 Acton et al.
3,999,802 A 12/1976 Powers
4,240,663 A 12/1980 Locher
4,290,645 A 9/1981 Glickman et al.
4,305,617 A 12/1981 Benoit
4,522,444 A * 6/1985 Pollock ..... 297/239
4,618,185 A 10/1986 Kaufman
4,648,653 A 3/1987 Rowland
4,828,320 A * 5/1989 Saiger ..... 297/229
5,002,337 A 3/1991 Engel et al.
5,123,702 A 6/1992 Caruso
5,154,474 A 10/1992 Desanta
5,154,486 A * 10/1992 Gehry ..... 297/451.9
5,524,963 A 6/1996 Barile
5,626,394 A 5/1997 Perry
5,690,387 A * 11/1997 Sarti ..... 297/397
D393,757 S 4/1998 Breen
5,762,396 A 6/1998 Barile
RE36,335 E 10/1999 Perry
5,961,184 A 10/1999 Balderi et al.
5,997,084 A 12/1999 Barile, Jr. et al.
5,997,094 A 12/1999 Cvek
6,003,948 A 12/1999 Holbrook
6,116,692 A 9/2000 Tarnay et al.
D433,578 S 11/2000 Saul
D433,836 S 11/2000 Barile, Sr.
6,206,469 B1 3/2001 Caruso et al.
6,679,551 B2 1/2004 Ware et al.
2002/0053822 A1 5/2002 Ware et al.

(Continued)

*Primary Examiner*—Milton Nelson, Jr.
(74) *Attorney, Agent, or Firm*—Butzel Long

(57) ABSTRACT

The specification discloses a stackable chair, and framework therefor, that adapted for vertical stacking in closely conforming relation with at least one other chair of identical configuration, the stackable chair comprising a framework dimensioned for a human being, the framework defining legs, a back rest support, and a seating surface support, and a seating surface and a back rest disposed on the framework. The framework is at least substantially comprised of one or more frame elements each having a thickness of less than $7/16^{th}$ inches, the one or more frame elements further being configured so that the framework is characterized by a stacking thickness of less than $7/16^{th}$ inches.

24 Claims, 8 Drawing Sheets

U.S. PATENT DOCUMENTS

2002/0149246 A1 10/2002 Lucci et al.
2003/0047981 A1 3/2003 Roth
2003/0201661 A1 10/2003 Ware et al.
2004/0061365 A1 4/2004 Crue
2004/0108761 A1 6/2004 Lucci et al.

* cited by examiner

STACKABLE CHAIR AND FRAMEWORK THEREFOR

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

FIELD OF THE INVENTION

The present invention relates to the field of stacking chairs, and more particularly to a stackable chair, and framework therefor, that is adapted for vertical stacking in closely conforming relation with at least one other chair of identical configuration, the stackable chair comprising a framework at least substantially comprised of one or more frame elements each having a thickness of from less than $7/16^{th}$ inches, the one or more frame elements of the framework being configured so that the framework is characterized by a stacking thickness of less than $7/16^{th}$ inches.

BACKGROUND OF THE INVENTION

Stacking chairs—that is, chairs of identical configuration adapted for vertical stacking one on top of the other in closely conforming relation—have long been known. Exemplary of the essential configuration of such chairs is the disclosure of Rowland, U.S. Pat. No. 3,278,227, which disclosure is incorporated herein by reference in its entirety. But while improvements have been made to various aspects of such chairs over the years, including improvements directed at realizing ever more compactly stackable chairs to maximize the number thereof which may be stacked in a given vertical distance, these improvements have been hampered by the structural requirements for the individual chairs themselves.

More specifically, it is known to be necessary that each stackable chair be capable of meeting certain predefined strength requirements, such as are set forth, for example, by the Business and Institutional Furniture Manufacturer's Association ("BIFMA") and the American National Standards Institute ("ANSI"). Exemplary in these regards are the standards embodied by ANSI/BIFMA X5.1-2002. In consequence of such requirements, the convention in stackable chair design has been to utilize robust materials, especially for the chair's framework. Typically, and as disclosed in the aforementioned patent of Rowland, the framework material of choice has been steel rod of no less than $7/16^{th}$ inches in diameter. Unfortunately, the heretofore necessary employment of such material has effectively defined a lower limit of no less than $7/16^{th}$ inches on the stacking thickness—that is, the contribution which each in a plurality of stacking chairs makes to the total height of a stack of such chairs.

SUMMARY OF THE DISCLOSURE

The present invention encompasses improvements to the prior art by providing a stackable chair, and framework therefor, that is adapted for vertical stacking in closely conforming relation with at least one other chair of identical configuration, the stackable chair comprising a framework defining legs, a back rest support, and a seating surface support, and a seating surface and a back rest disposed on the framework. The framework is at least substantially comprised of one or more frame elements each having a thickness of less than $7/16^{th}$ inches, these one or more frame elements being configured so that the framework is characterized by a stacking thickness of less than $7/16^{th}$ inches.

According to one feature hereof, the seating surface and the back rest comprise a monolithic seating element. Per another feature, the monolithic seating element is removably attachable to the framework.

In one aspect of the present invention, the monolithic seating element comprises a generally planar member having a principal area defining the seating surface and the back rest, the generally planar member further including at opposite ends thereof tab portions each removably positionable between the metal framework and the principal area of the generally planar member.

Per still another feature herein, the monolithic seating element may be fabricated from metal or from a semi-rigid material, such as, for instance, plastic.

According to yet another aspect of this invention, the metal framework comprises a plurality of metal rods each having a diameter of from approximately $5/16^{th}$ inches to less than $7/16^{th}$ inches. The metal framework may further comprise a plurality of sub-frames each fabricated from at least one metal rod, the plurality of metal rods forming the plurality of sub-frames each having a diameter of from approximately $5/16^{th}$ inches to less than $7/16^{th}$ inches. Per one feature hereof, the plurality of sub-frames may each be fabricated from a single metal rod having a diameter of from approximately $5/16^{th}$ inches to less than $7/16^{th}$ inches.

In another embodiment, the present invention comprehends a stackable chair adapted for vertical stacking in closely conforming relation with at least one other chair of identical configuration, the stackable chair comprising a framework dimensioned for a human being, the framework defining legs, a back rest support, and a seating surface support, and a monolithic seating element removably securable to the framework, the seating element comprising a generally planar member having a principal area defining a seating surface and a back rest, and the generally planar member further including at opposite ends thereof tab portions each removably positionable between the metal framework and the principal area of the generally planar member.

Per one aspect of this embodiment, the monolithic seating element may be fabricated from metal or a semi-rigid material such as, for instance, plastic.

BRIEF DESCRIPTION OF THE DRAWINGS

These and other features of the instant invention will be better understood with reference to the following description and accompanying drawings, of which.

WRITTEN DESCRIPTION

Figure 1:
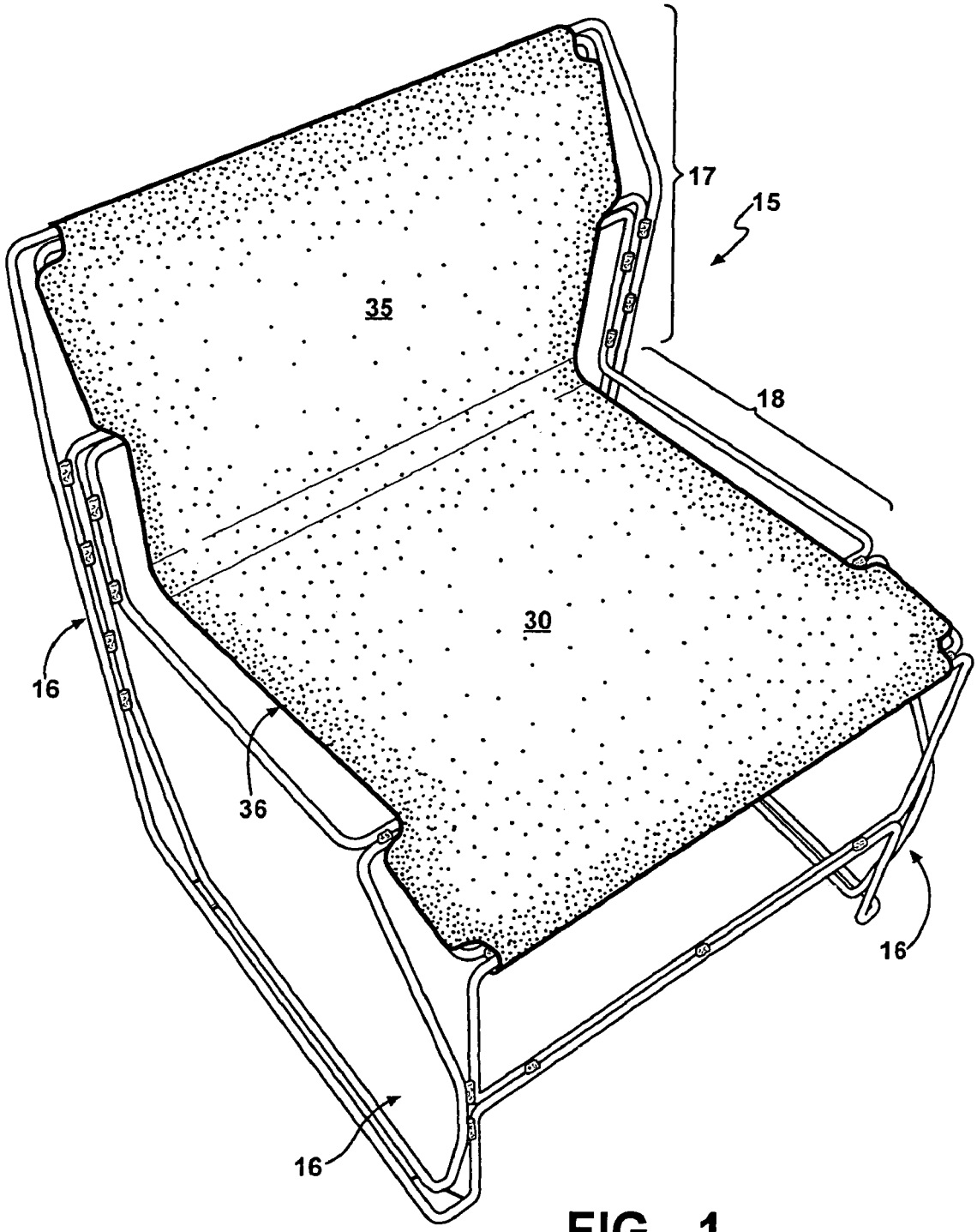
FIG. 1 is a perspective view of the stackable chair of the present invention according to one exemplary embodiment thereof.

Referring now to the drawings, the present invention will be seen to generally comprise, in a first exemplary embodiment thereof (FIG. 1), a stackable chair adapted for vertical stacking in closely conforming relation with at least one other chair of identical configuration, the stackable chair comprising a framework (indicated generally at 15) defining legs (indicated generally at 16), a back rest support (indicated generally at 17), and a seating surface support (indicated generally at 18), as well as a seating surface 30 and a back rest 35 disposed on the framework. The framework is at least substantially comprised of one or more frame elements each having a thickness of less than $7/16^{th}$ inches, these one or more frame elements being configured so that the framework is characterized by a stacking thickness of less than $7/16^{th}$ inches.

As used herein, the following terms have the following definitions:

"Stacking thickness" means and refers to the thickness which each stacking chair contributes to the total height of a stack of identical such chairs arranged vertically one on top of the other;

"Stacking density" refers to the number of identical stacking chairs which can be stacked one on top of the other within a given vertical distance. Thus, as between a first stack of stacking chairs $C_1$ and a second stack of different stacking chairs $C_2$, the stack with the greater number of chairs over the same vertical distance will be characterized by the greater stacking density; and "Dimensioned for a human being" means and refers to a stackable chair, or the framework thereof, which is dimensioned to act as a seat for a person, as opposed, for example, to a doll, a small animal, etc. Thus, as used herein, the term "for a human being" is intended only to distinguish a stackable chair, or the framework thereof, designed for people from such a chair designed for some other utility, and so is not intended to imply any particular load bearing or other strength characteristics.

Figure 2:
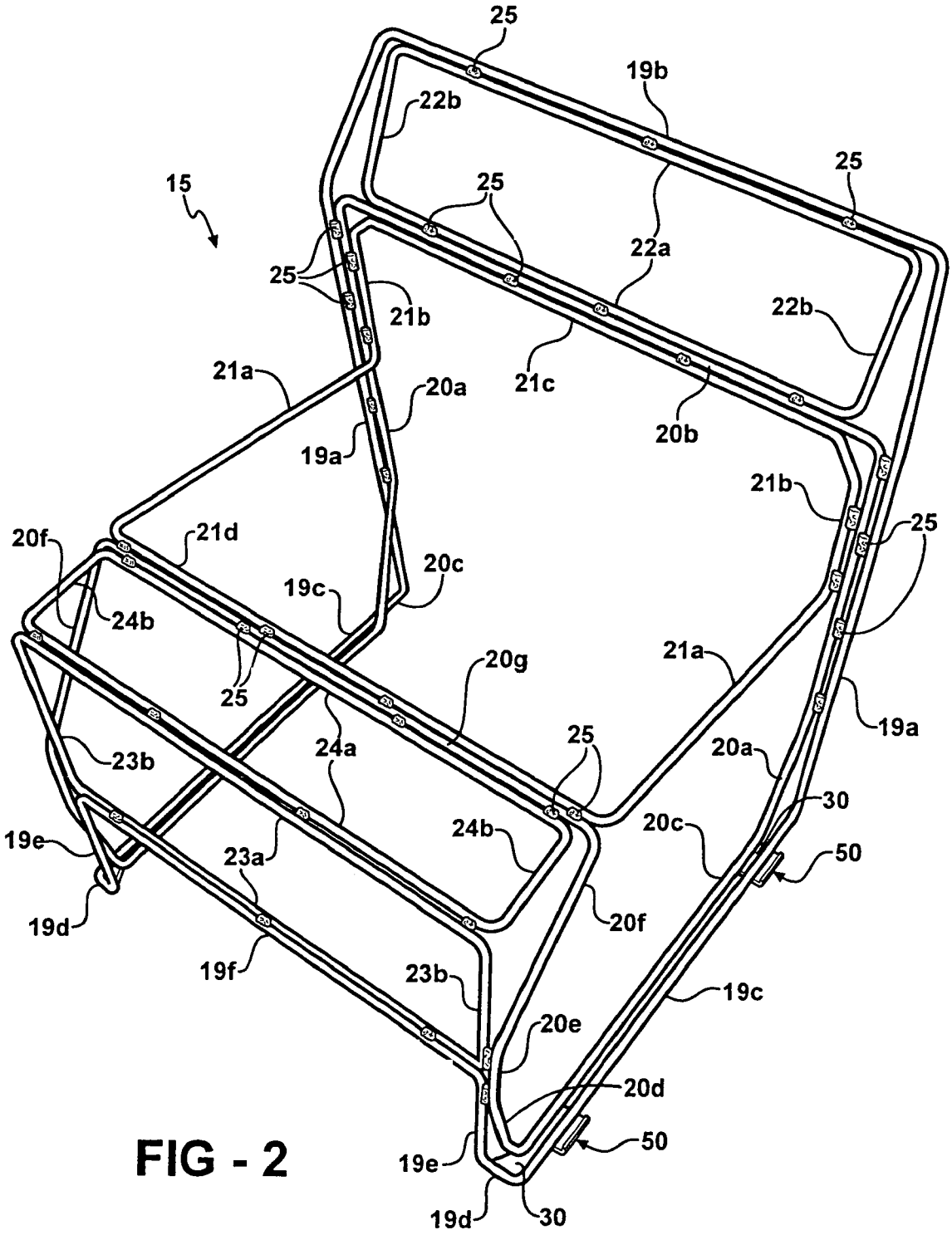
FIG. 2 is a perspective view of the stackable chair of FIG. 1, showing only the framework thereof.

Referring also to FIG. 2, the framework 15 is a metal framework specifically characterized in the illustrated embodiment by frame elements taking the form of a plurality of metal rods each having a diameter of less than $7/16^{th}$ inches, and more specifically of approximately $5/16^{th}$ inches, the rods arranged and interconnected to define each of the legs, back rest support, and seating surface support. More particularly, the metal rods of the framework 15 are arranged to at once define a structure that is suitably robust while maintaining a stacking thickness of the framework which is less than $7/16^{th}$ inches—in the illustrated embodiment, of no greater than about $5/16^{th}$ inches—so as to increase the stacking density of the inventive chair in comparison to prior art stacking chairs.

To achieve the foregoing there is provided, according to the exemplary framework 15 of FIGS. 1 and 2, a plurality of interconnected sub-frames, as follows:

A first sub-frame includes two spaced-apart, generally parallel-disposed, vertically extending sections 19*a* each defining a part of the legs 16 at the rear of the chair, these vertically extending sections 19*a* transitioning to, at upper ends thereof, a horizontally extending, intermediate section 19*b* which interconnects the vertically extending sections 19*a* and which defines a part of the back rest support. As shown, the vertically extending sections 19*a* are both angled proximate their upper ends slightly rearwardly away from the main body of the framework to yield a rearwardly angled seat back in the fully constructed chair (as shown in FIG. 1).

Figure 3:
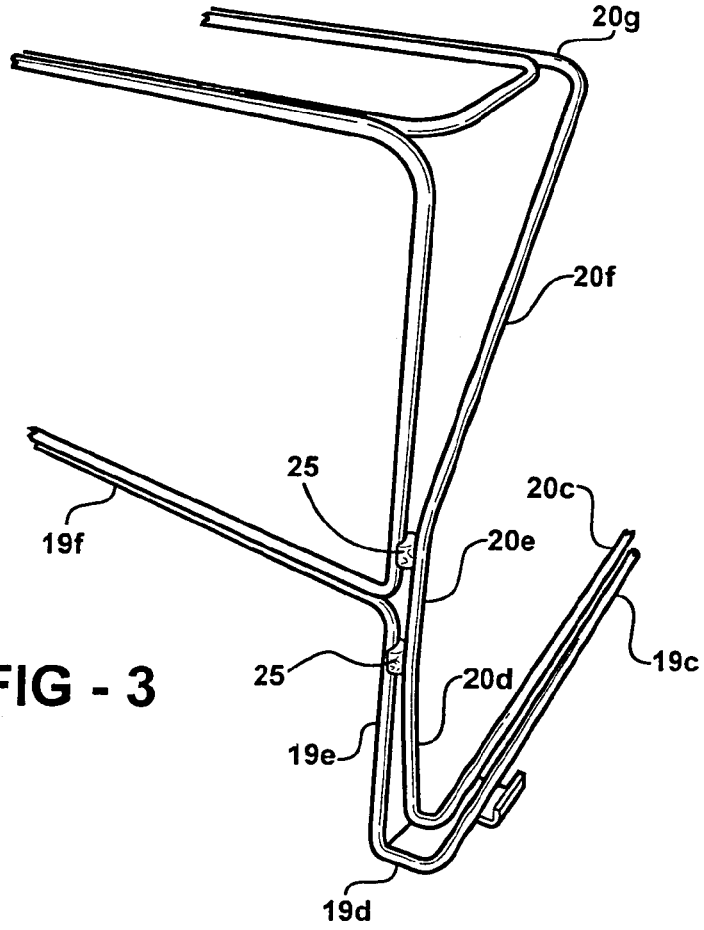
FIG. 3 is a detailed perspective view of the front left quarter of the framework of FIG. 2.

Proximate the vertically lower end of each vertically extending section 19*a* the first sub-frame defines a pair of spaced-apart, horizontally-disposed, forwardly extending sections 19*c*. Referring also to FIG. 3, the horizontally extending sections 19*c* may each be seen to terminate proximate the front of the chair framework in a short front section 19*d* oriented approximately at a right angle to the forwardly extending section 19*c*, this front section 19*d* subsequently yielding to a vertically extending section 19*e* defining a part of each of the legs 16 (FIG. 1) at the front of the chair. At their upper ends the opposite vertically-extending sections 19*e* transition to a horizontally disposed intermediate section 19*f* which runs between the upper ends of these sections 19*e*.

With continuing reference to FIGS. 2 and 3, there is also provided a second sub-frame comprising two spaced-apart, vertically extending sections 20*a* each defining, along with the vertical sections 19*a* of the first sub-frame, a part of the legs 16 (FIG. 1) at the rear of the chair. Proximate their upper ends, vertically extending sections 20*a* transition to and are interconnected at these upper ends by a horizontally extending, intermediate section 20*b* spaced vertically apart from the intermediate section 19*b* and also defining a part of the back rest support 17 (FIG. 1). For a portion of their length, vertically extending sections 20*a* are disposed closely adjacent and parallel with the vertical sections 19*a*, as shown, with these sections 19*a* and 20*a* being interconnected, such as by welds 25. Proceeding vertically downward therefrom, the sections 20*a* are each disposed at an oblique angle running forwardly and terminating in a pair of spaced-apart, horizontally-disposed sections 20*c* each of which runs generally parallel with and inside of the sections 19*c* of the first sub-frame. These sections 20*c* and 19*c* are, according to the illustrated embodiment, interconnected along a portion of their lengths by rigid plates 30 welded to each of the sections 19*c* and 20*c*.

Referring specifically to FIG. 3, the forwardly extending sections 20*c* each terminate in a short, inwardly extending section which yields to an upwardly-extending section 20*d* that angles outwardly towards and is connected, such as by welds 25, to an outside surface of vertically-extending section 19*e*. This upwardly extending section 20*d* leads to a small vertically oriented section 20*e* disposed parallel with vertically-extending section 19*e* from which section 20*f* angles rearwardly and upwardly as shown.

Each of sections 20*a*, 20*d*, 20*e* and 20*f* as described and illustrated will be understood to comprise a part of each leg 16

(FIG. 1) of the chair, with the angled dispositions of sections 20*a* and 20*f* imparting greater structural strength to the framework 15.

Referring specifically to FIG. 2, the vertically-uppermost ends of sections 20*f* transition to and are interconnected by a horizontally-extending section 20*g*.

Continuing to refer to FIG. 2, a third sub-frame of the exemplary framework 15 comprises spaced-apart, parallel-disposed, generally horizontally extending sections 21*a* each defining a lateral part of the seating surface support 18. At the rearward ends thereof each of the sections 21*a* terminates in and transitions to vertically upwardly extending sections 21*b* disposed inside of and parallel to the vertically extending sections 20*a* of the second sub-frame. These sections 21*b*, in turn, transition at their upper ends to a generally horizontally extending intermediate section 21*c*, as shown. The intermediate section 21*c* is disposed parallel to and vertically beneath the intermediate section 20*b* of the second sub-frame. At their opposite, forward ends the frame sections 21*a* each transition to and are interconnected by a generally horizontally extending intermediate section 21*d* disposed parallel and immediately to the inside of section 20*g* of the second sub-frame. Each of the intermediate sections 21*c* and 21*d*, as well as the vertically extending sections 21*b*, are all connected to the second sub-frame via welds 25 at various locations, as depicted.

Still referring to FIG. 2, a fourth sub-frame forming part of the back rest support 17 (FIG. 1) is characterized by a generally rectangular shape comprised of generally vertically spaced-apart, horizontally extending sections 22*a* interconnected at opposite ends thereof by generally vertically-extending sections 22*b*. As shown, this fourth sub-frame is disposed between and connected to the intermediate section 19*b* of the first sub-frame and the intermediate section 20*b* of the second sub-frame via welds 25.

With continuing reference to FIG. 2, a fifth sub-frame forming part of the seating surface support 18 (FIG. 1) and legs 16 (FIG. 1) proximate the front of the chair is also characterized by a generally rectangular shape comprised of vertically spaced-apart, horizontally extending sections 23*a* interconnected at opposite ends thereof by vertically-extending sections 23*b*. As depicted, this fifth sub-frame is disposed between and connected to the intermediate section 19*f* of the first sub-frame and a horizontally extending section 24*a* of the sixth sub-frame (described subsequently) via welds 25, and further connected, also via welds 25, to the vertically-oriented section 20*e* of the second sub-frame.

A sixth sub-frame (FIG. 2) forming part of the seating surface support 18 (FIG. 1) and interconnecting the seating surface support 18 (FIG. 1) to the legs 16 (FIG. 1) at the front of the chair is also characterized by a generally rectangular shape comprised of spaced-apart, horizontally extending sections 24*a* interconnected at opposite ends thereof by spaced-apart, horizontally extending sections 24*b*. This sixth sub-frame is, as shown, disposed between and connected to the intermediate section 20*g* of he second sub-frame and a horizontally extending section 23*a* of the fifth sub-frame vi welds 25.

As mentioned previously, the foregoing sub-frames are interconnected at various locations, such as via welds 25, as shown, to thus form the unitary framework 15 of the exemplary embodiment. Of course, other conventional means may be employed to interconnect the various sub-frames where the framework 15 is so constituted of multiple constituent parts. And while, as depicted, the several sub-frames of the exemplary framework 15 are each fashioned from a single metal rod having a diameter of less than $7/16^{th}$ inches (and specifically, according to the illustrated embodiment, of approximately $5/16^{th}$ inches) and being bent or otherwise formed into the configuration of the sub-frame, it will be understood that each such sub-frame may be fashioned from one or more such rods to achieve the same structure as illustrated.

It will be appreciated from the foregoing description of the exemplary framework 15 as shown that there is provided a framework for a stacking chair which is at once made suitably strong—by reason of the various frame elements being interconnected, such as by welds, and the orientation of these frame elements to form gussets and like structural members—while still, by reason of the disposition and relative orientation of the frame elements forming the same—according to which such frame elements in one stackable chair so formed interfere as minimally as possible with the stacking thereon of a second stackable chair identically formed—there is provided a framework for a stackable chair characterized by a stacking thickness of less than $7/16^{th}$ inches.

Still more particularly, the chair of the illustrated embodiment is characterized by a structural strength at least comparable to that of prior art chairs as established by successfully subjecting the exemplary inventive framework to the load test set out in ANSI/BIFMA X5.1-2002 test no. 5, according to which the framework is restrained on its side and a 75 lb weight is applied one inch from the bottom of the front and rear legs for 1 minute each. Under such testing, the exemplary framework of the present invention has displayed no structural breakage or loss of serviceability.

Of course, numerous variations of the exemplary framework 15 are envisioned which would likewise employ the principles herein disclosed and so yield a stacking chair contemplated by the claims hereof—that is, a stacking chair having a framework substantially comprised of one or more frame elements each having a thickness of less than $7/16^{th}$ inches, and the one or more frame elements being configured so that the framework is characterized by a stacking thickness of less than $7/16^{th}$ inches—and those skilled in art, having the benefit of this disclosure, will appreciate that such other frameworks may, by way of example and without limitation, comprise one or more frame elements made of metal or other suitably strong materials, the one or more frame elements being fashioned by bending, molding, casting, or other known techniques, and the one or more frame elements configured other than as exemplified to nevertheless produce a suitably strong yet characterized by a stacking thickness of less than $7/16^{th}$ inches. As will also be appreciated, a framework according to the present invention need not comprise frame elements all of the same thickness. Rather, such framework may alternatively comprise one or more frame elements characterized by varying thicknesses in the range of below $7/16^{th}$ inches, and preferably in the range of from approximately $5/16^{th}$ inches to less than $7/16^{th}$ inches.

Figure 4:
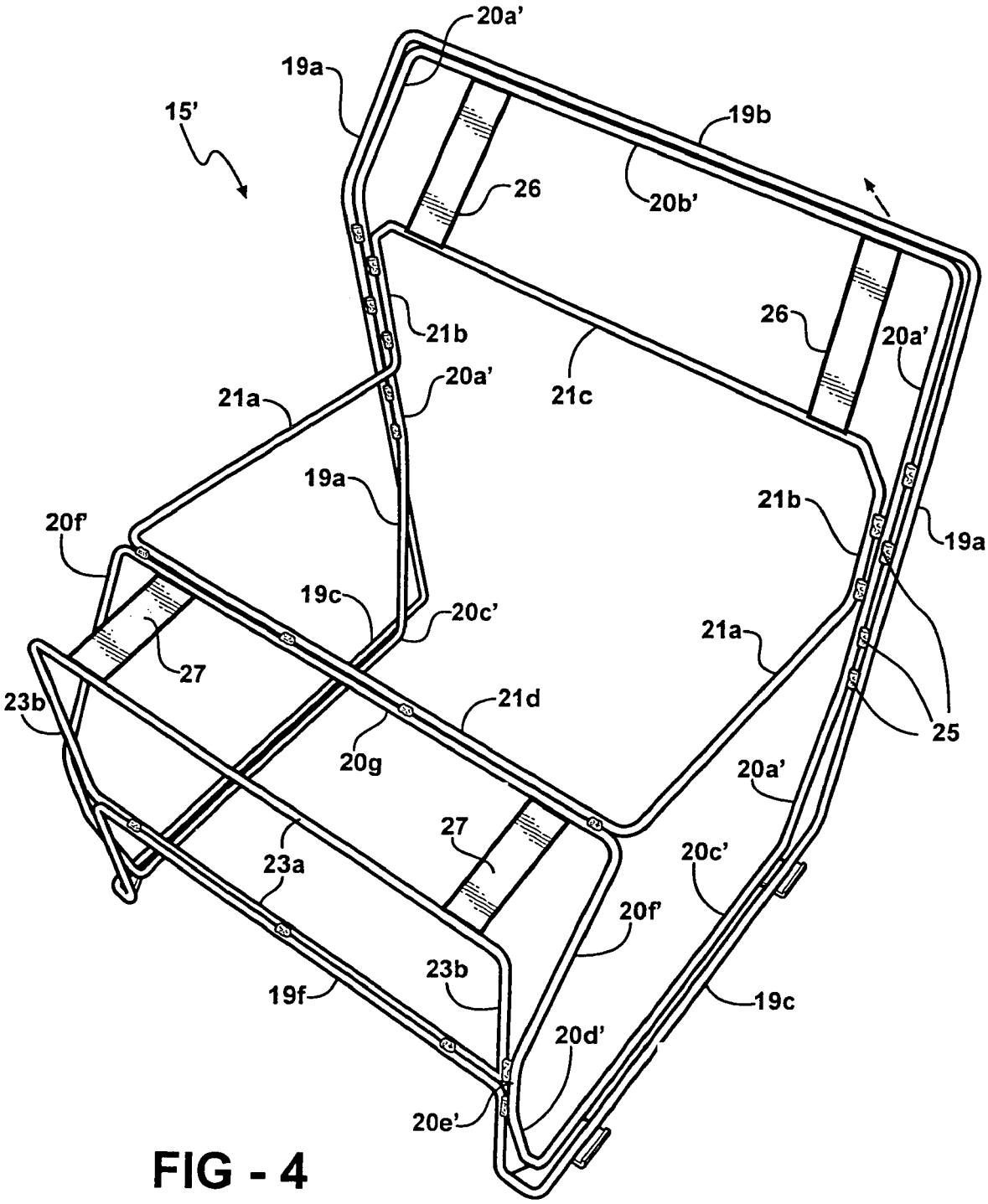
FIG. 4 is a perspective view of a stackable chair framework according to one alternate embodiment of the present invention.

By way of example, there is shown in FIG. 4 one such alternative embodiment wherein the framework 15' is as previously described with the exception that the second sub-frame has been altered so that the upper part of vertically extending sections 20*a'* run parallel and adjacent to the upper part of vertically extending sections 19*a*, and intermediate section 20*b'* runs parallel to intermediate section 19*b* of the first sub-frame, while generally planar, rigid reinforcing members 26, 27 interconnected at their ends to and spanning between the frame sections 20', 21*c* and 23*a*, 21*d*, respectively, have been substituted for the fourth and sixth sub-frames, respectively.

Still more particularly, it will be seen from FIG. 4 that vertically extending sections 20*a'* of the second sub-frame of this embodiment are disposed inside of and extend upwardly along the length of the vertically extending sections 19*a* of the first sub-frame, running closely parallel thereto and being connected, such as by welds 25, proximate a substantial part of the length thereof. Likewise, the intermediate section 20*b*' is disposed closely adjacent to and beneath the intermediate section 19*b* of the first sub-frame. There is further provided in this first alternative embodiment of the framework 15 in place of the fourth sub-frame a pair of spaced-apart, rigid, generally planar frame elements comprising reinforcing members 26 each interconnected, such as by welds, etc., at their opposite ends to the intermediate section 20*b*' of the second sub-frame and the intermediate section 21*c* of the third sub-frame. And in place of the sixth sub-frame there is provided a second pair of spaced-apart, rigid, generally planar frame elements comprising reinforcing members 27 each interconnected, also such as by welds, etc., at opposite ends thereof to the intermediate section 20*g*' of the second sub-frame and an intermediate section 23*a* of the fifth sub-frame. Each of the reinforcing members 26, 27 are characterized by a thickness of less than $7/16^{th}$ inches, so as not to exceed the less than $7/16^{th}$ inch stacking thickness of the framework as a whole.

Still other embodiments of the present invention may, as indicated, comprise a framework 15 fashioned from more or fewer frame elements, including, for example, more of fewer sub-frame portions and/or reinforcing members than as described in the exemplary embodiments.

Figure 5:
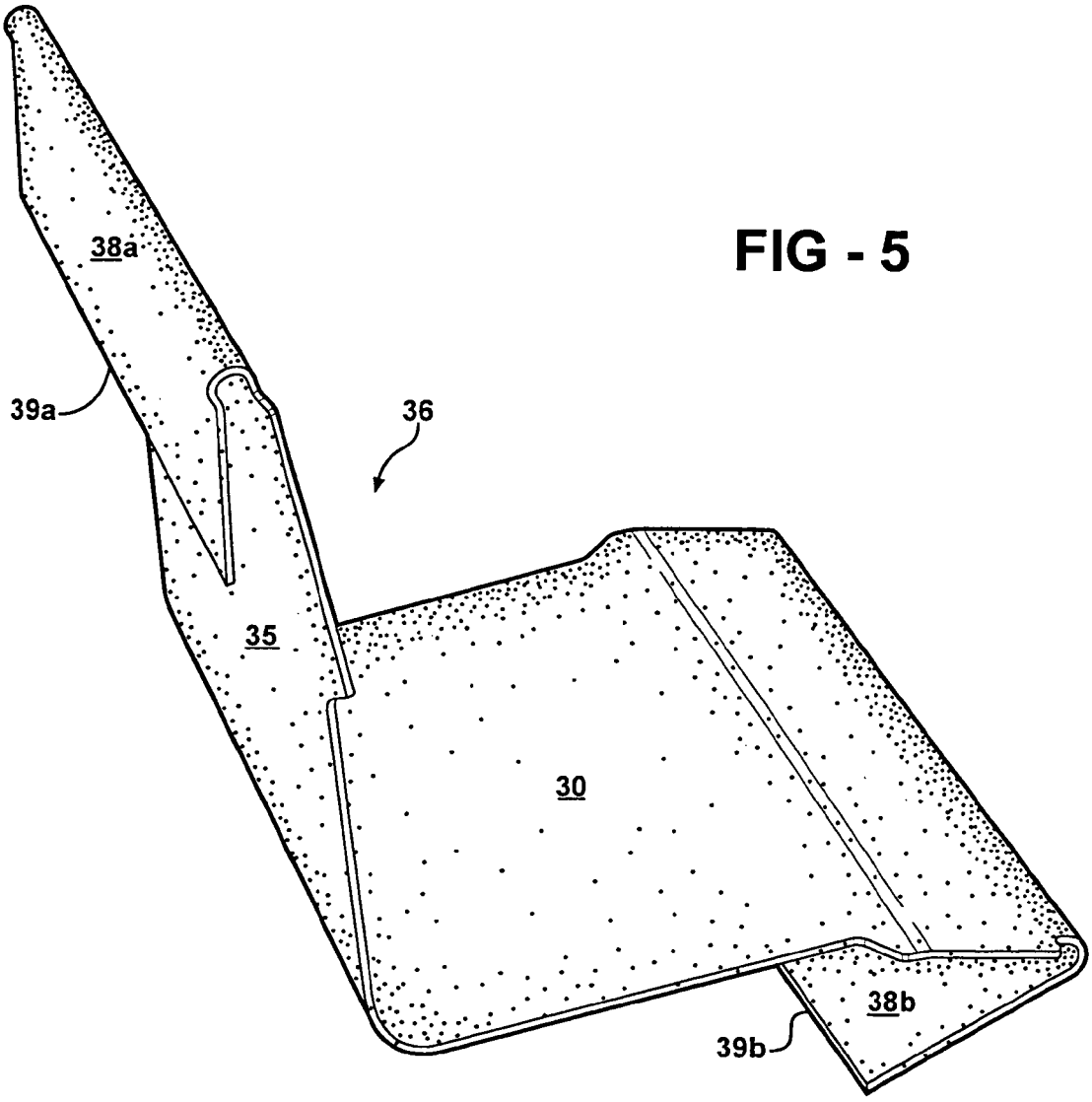
FIG. 5 is a perspective view of the seating surface and back rest according to one exemplary embodiment of the present invention, wherein the same are embodied in a monolithic seating element.

Referring now to FIGS. 1 and 5, seating surface 30 and a back rest 35 will be seen to take the form, in the illustrated embodiment of this invention, a monolithic seating element 36 securely connected to and supported by at least the back rest 17 and seating surface support 18 of the framework 15.

The monolithic seating element 36 comprising the seating surface 30 and back rest 35 of the illustrated embodiment of the present invention is preferably formed of a generally planar material that is sufficiently strong while simultaneously being sufficiently thin in cross-section so as to add little or a negligible amounts to the stacking thickness of a stacking chair incorporating the inventive framework (although, as described below, it is further contemplated that this seating element 36 may be selectively removable from the framework 15, including for purposes of stacking the framework of this invention). Exemplary materials capable of meeting these requirements may be rigid or flexible in nature and include, without limitation, metals, textiles, and polymeric materials.

Figure 6:
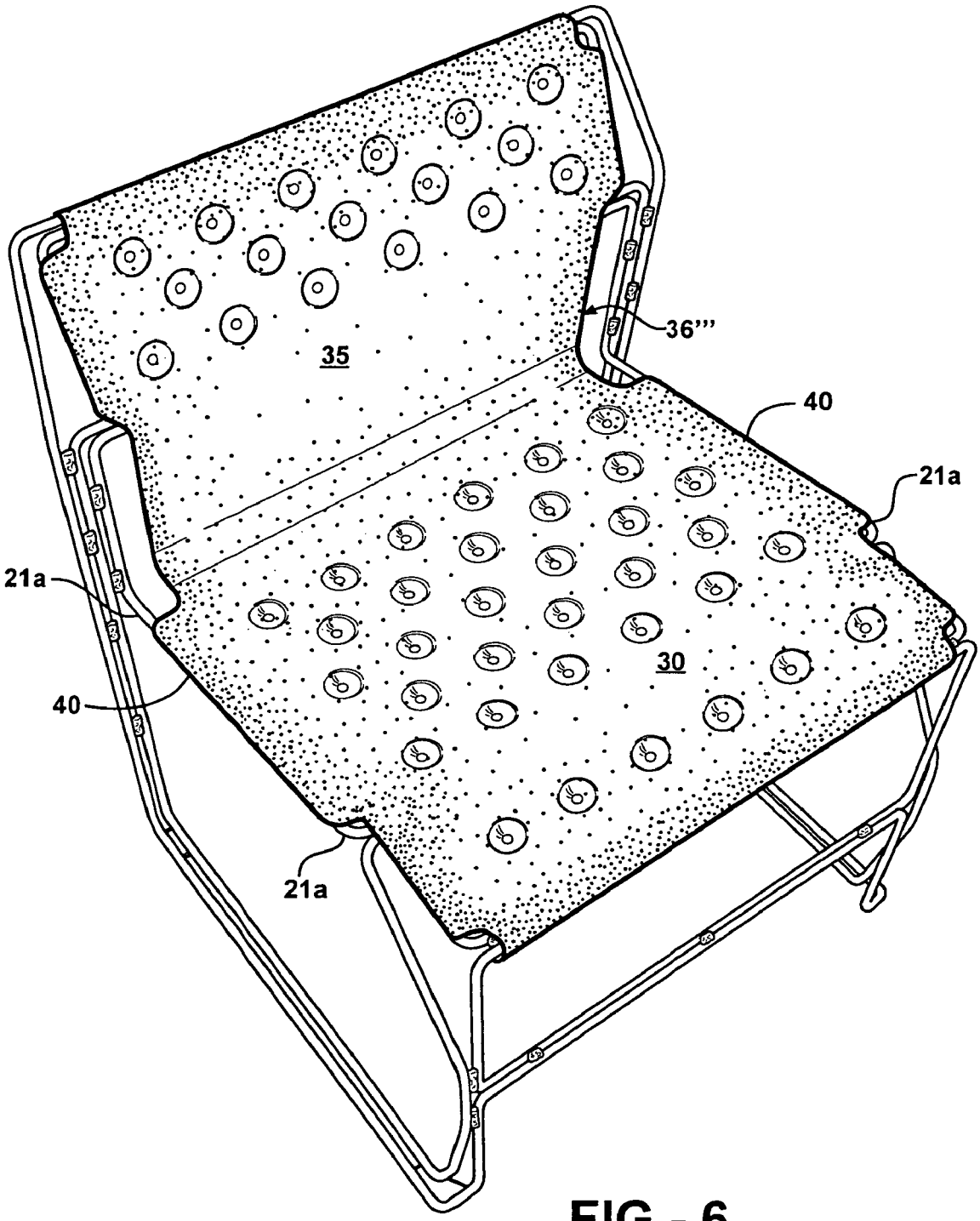

According to one embodiment hereof, shown in FIG. 6, the monolithic seating element 36 is fashioned from a relatively thin sheet of metal, for instance by stamping. In order to fashion the seating element 36 from as thin a material as possible, the seating element 36 preferably defines a large contact surface to thereby reduce the load applied per given area thereof.

Still referring to FIG. 6, a plurality of holes 37 may further be defined through each of the seating surface 30 and the back rest 35, as desired, in order to facilitate air circulation and to permit liquid to drain from the surface of the chair (such as, for instance, where the chair is employed out of doors). Similarly, the seating surface 30 may be formed to include ribs (not shown) or the like to increase the structural strength of the seating element 36.

And while not illustrated, it will also be appreciated that the seating surface 30 and the back rest 35 may comprise separate elements independently secured to the framework 15, as opposed to the illustrated monolithic structure.

Figure 7:
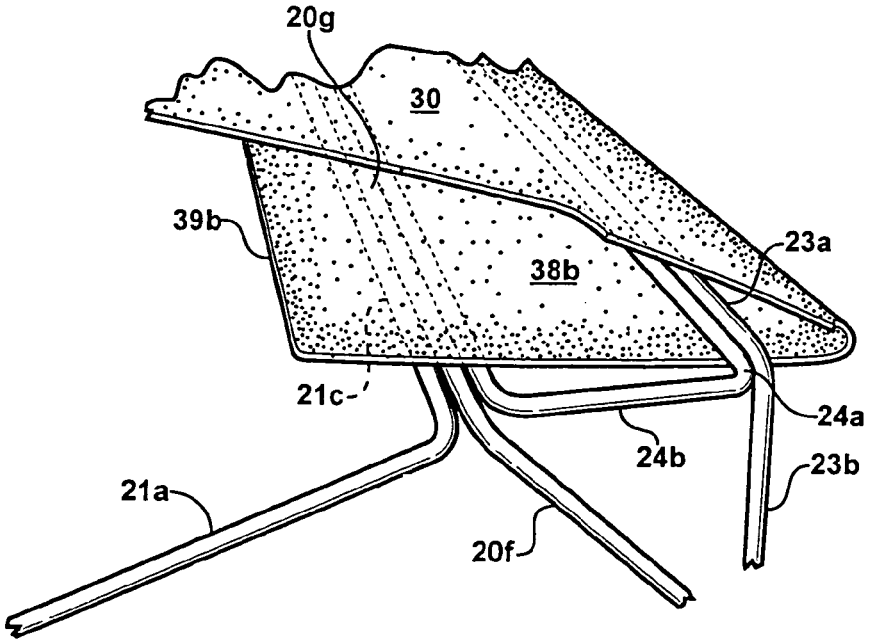
FIGS. 6 and 7 are detailed perspective views of the inventive chair, illustrating one manner of securement of a seating element to the frame thereof.
Figure 8:
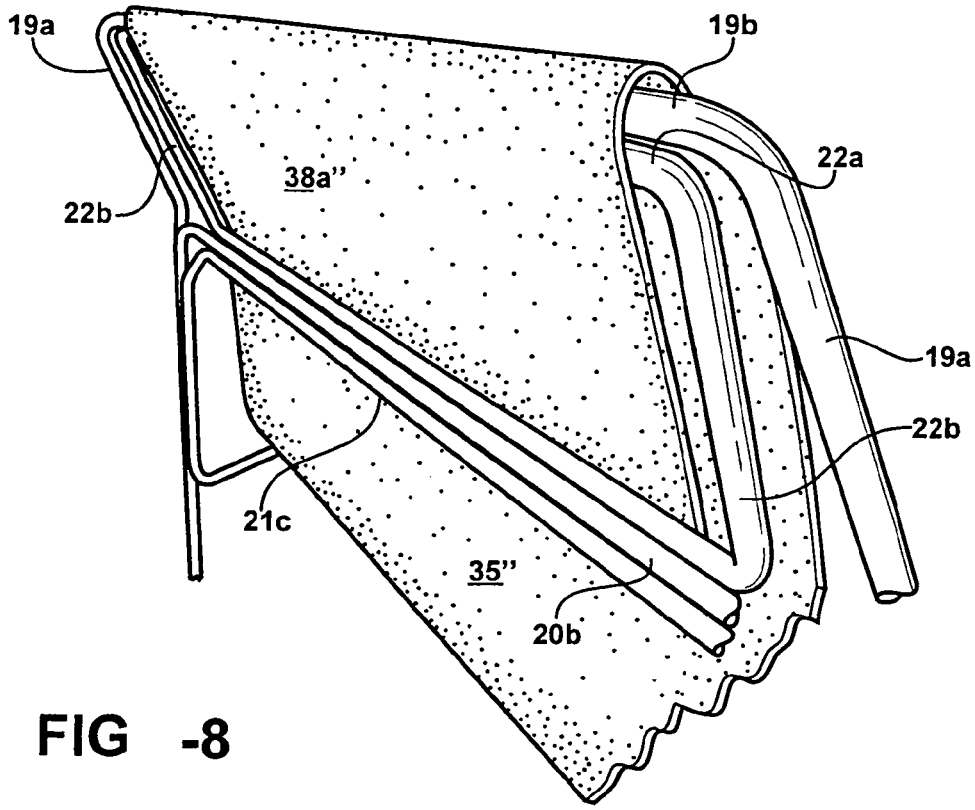
FIG. 8 is a detailed perspective view of the inventive chair, illustrating one alternative embodiment in the manner of securement of a seating element to the frame thereof.

Referring now to FIGS. 5, 7, and 8, the monolithic seating element 36 of the illustrated embodiment may further be adapted for securement to the framework 15 in a manner such as hereafter described.

More particularly, the monolithic seating element 36 of this embodiment is provided with tab portions 38*a*, 38*b* at opposite ends thereof, one such tab portion disposed adjacent each of the seating surface 30 and back rest 35. As depicted, the tab portions 38*a*, 38*b* are each formed by bends in the monolithic seating element 36 by which the free ends 39*a*, 39*b* of the attachment tab portions 38*a*, 38*b*, respectively, project back towards the main body of the seating element 36. As shown best in FIG. 8, tab portion 38*a* is further characterized by a principal length which is at least as great as the distance between the intermediate section 19*b* of the first sub-frame and the intermediate section 21*c* of the third sub-frame, while, as best shown in FIG. 7, tab portion 38*b* is characterized by a principal length which is at least as great as the distance between the intermediate section 23*d* of the fifth sub-frame and the intermediate section 21*c* of the third sub-frame.

With continuing reference to FIGS. 7 and 8, it may be seen that each of the tab portions 38*a*, 38*b* is adapted to be received in the framework 15 in such a manner that the seating element 36 will be securely retained in place when the seat is used by a person. More specifically, the tab portion 38*a* is dimensioned to be slidingly received, free end 39*a* first, within the opening bounded by the frame sections 22*a* and 22*b* of the fourth sub-frame such that at least a part of the tab portion 38*a* is disposed between the back rest 35 of the seating element 36 and the intermediate sections 20*b*, 21*c*, and 22*a* of the second, third, and fourth sub-frames, respectively (FIG. 8). Similarly, the tab portion 38*b* is dimensioned to be slidingly received, free end 39*b* first, within the opening bounded by the frame sections 24*a* and 24*b* of the sixth sub-frame such that at least a part of the tab portion 38*b* is disposed between the seating surface 30 of the seating element 36 and the intermediate sections 20*g*, 21*c*, and 24*a* of the second, third, and sixth sub-frames, respectively (FIG. 7). In this condition, it will be understood that the weight of a person seated upon the seating element 36 will urge the back rest 35 and seating surface 30 against the tab portions 38*a*, 38*b*, respectively, thus capturing these tab portions between the seating element 36 and at least the indicated frame sections of the framework 15 and so securely retaining the seating element 36 in place on the framework 15.

Figure 9:
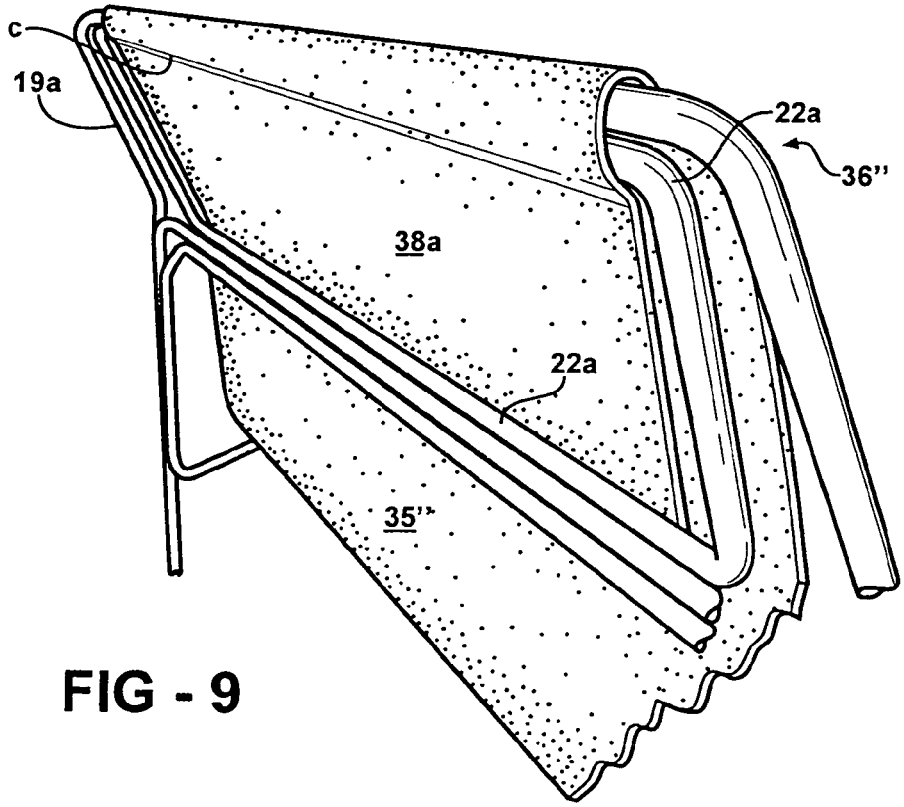
FIG. 9 is a perspective view of a stackable chair of the present invention according to one alternate embodiment thereof.

Referring next to FIG. 9, there is depicted an alternative embodiment of the inventive seating element 36" wherein the same is crimped (designated at C) proximate the innermost frame section (22*a* in the illustration) so that the tab portion 38*a*' lies more closely adjacent the back rest 35" of the seating element 36". Such crimp may be formed in the seating element 36" either before or after the same is first secured to the framework. Further according to this embodiment, the seating element 36" is fashioned from any material which will retain the crimp C, including, without limitation, metals, polymers, etc. According to the foregoing construction, it will be appreciated that unintentioned withdrawal of the tab portion 38*a*' is further resisted by abutting contact between the crimped portion C of the tab portion 38*a*' and the frame section 22*a*.

In similar fashion to that described above, it will be appreciated that the tab portion 38*b* may likewise be crimped so as to create a like abutting contact between such crimped portion thereof and the intermediate frame section 24*a* (see FIG. 7).

Turning again to FIG. 6, the seating surface 30 may, in one embodiment thereof, be provided with laterally extending portions 40 the dimensions of which serve to extend the seating surface 30 over the sections 21*a* of the third sub-frame and so provide greater support beneath the seating surface 30. These laterally extending portions 40 may, as desired, be of sufficient lateral dimensions so as to be crimped (not shown) over the frame sections 21*a*, or may otherwise include bent portions (not shown) for securing the laterally extending portions 40 to the frame sections 21*a*. According to this embodiment, wherein the seating surface 30 is embodied in a monolithic seating element 36''', the seating element 36''' is preferably formed from a rigid material, such as metal (shown), plastic, etc.

It will be appreciated in respect to the foregoing embodiments of the seating element 36 that the same provides for the secure attachment of a seat and backrest to a stackable chair frame without the employment of fastening means such as screws, bolts, etc. which characterize the construction of conventional stacking chairs. It will likewise be appreciated that such a seating element, when used in combination with a stackable chair having a framework as hereinabove described, may be selectively removed from the chair framework prior to stacking in order that the seating element not contribute to the stacking thickness of the chair.

Figure 10:
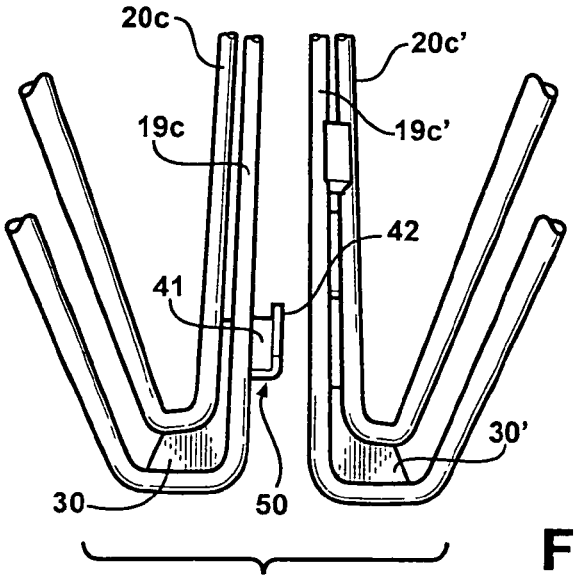
FIG. 10 is a detailed view of the legs of adjacent chairs according to the present invention, the drawing depicting a first means of ganging two or more chairs together in side-by-side relation.

With reference now being had to FIGS. 2 and 10, it will be seen that the present inventive stacking chair may further be provided with means for removably securing together—or "ganging"—multiple such chairs in side-by-side relationship.

More specifically, there is shown in the embodiment of FIGS. 2 and 10 a stacking chair in which there is provided a pair of brackets 50 fixed to and projecting outwardly from one of the horizontally extending sections 19*c* of the first sub-frame. Each such bracket includes a first horizontally disposed section 51 extending away from the frame section 19*c* a first distance approximately equal to the diameter of the frame section 19*c;* i.e., approximately $5/16^{th}$ inches. A second section 52 projects vertically upwards from the first section 15, this second section 52 being characterized by a material thickness no greater than the distance between the adjacent frame section 19*c* and frame section 20*c*.

In use, a first stacking chair (A, FIG. 10) as described is placed on a support surface (e.g., a floor), and a second, identical stacking chair (B, FIG. 10) is positioned next to the first chair so that the second section 52 of each bracket 50 is received between the adjacent frame section 19*c*' and frame section 20*c*' of the second chair, the frame section 19*c*' of the second chair further being received on the first section 51 of the bracket 50.

Figure 12:
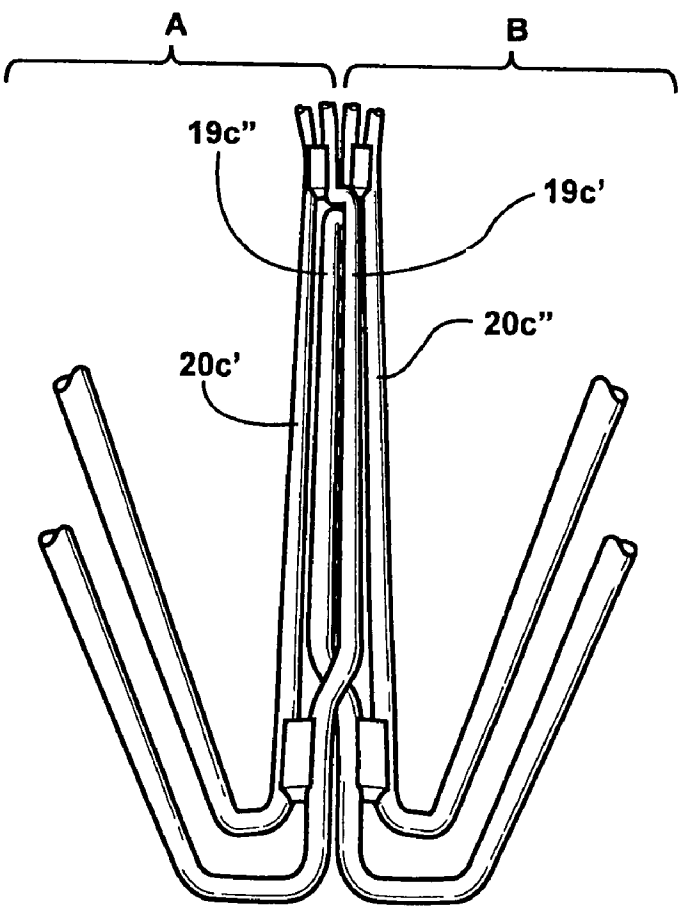
FIGS. 11 and 12 are detailed views of the legs of adjacent stacking chairs according to one embodiment of the present invention, the drawings together depicting a first alternative means of ganging two or more such chairs together.
Figure 11:
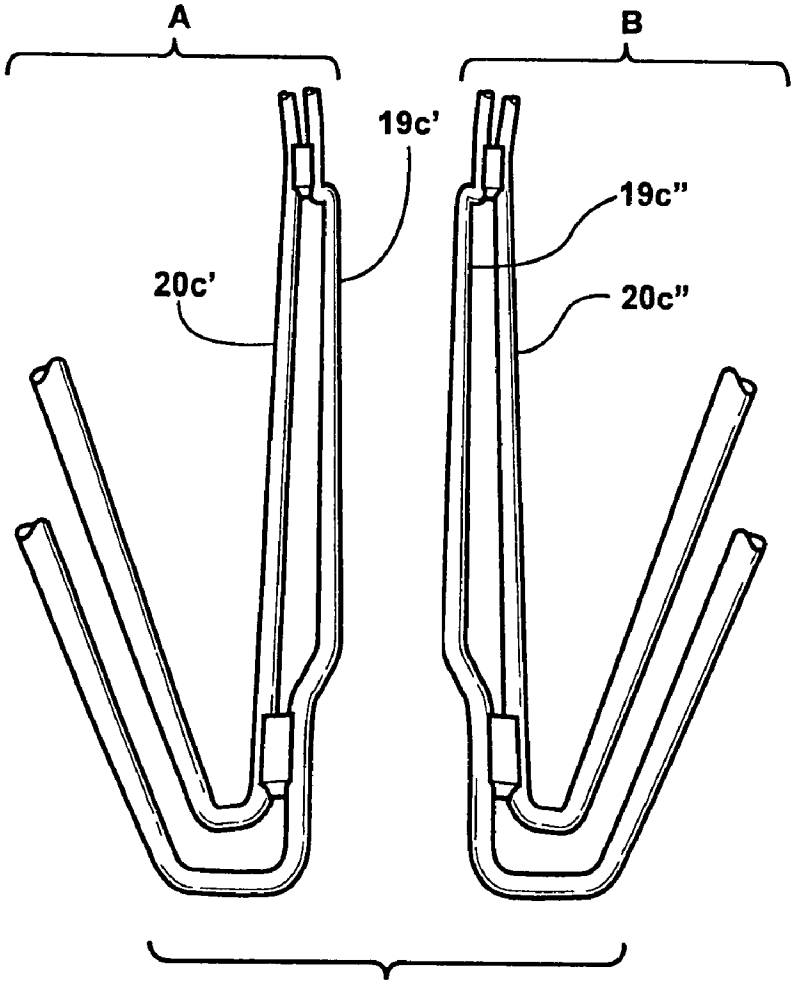

According to an alternative embodiment of such ganging means, shown in FIGS. 11. and 12, which depict the adjacent lower portions of frameworks for two identical chairs A and B, both pairs of opposite frame sections 19*c*' and 19*c*" for each chair A and B (only one such frame section 19*c*' and 19*c*" is shown for each chair A and B in FIGS. 11 and 12) are bent outwardly and at an upward angle in relation to the adjacent frame sections 20*c*' and 20*c*", as shown, to define interlocking elements. Also as shown, the interlocking element so defined on the left hand side of each chair (shown for the chair A) is larger than the interlocking element so defined on the right-hand side of each chair (shown for chair B), with the left-hand side interlocking element defining an opening O between the frame section 19*c*' and the frame section 20*c*' large enough to receive the right-hand side interlocking element therein (FIG. 12). By this construction, two or more chairs (such as A and B) may be laterally interconnected or "ganged" to prevent unwanted lateral separation thereof.

It will be appreciated, with reference being had to the foregoing disclosure, that the present invention provides a stacking chair which is at once robust in construction, economical to manufacture, and characterized by a higher stacking density than prior art stacking chairs.

Of course, the foregoing is merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A framework for a stackable chair that is adapted for vertical stacking in closely conforming relation with at least one other chair of identical configuration, the stackable chair framework being dimensioned for a human being, the stackable chair framework having legs, a back rest support, and a seating surface support, and the framework consisting essentially of a plurality of metal rods each having a maximum diameter of less than 0.433 inches, the plurality of metal rods being configured so that the framework is characterized by a stacking thickness of less than 0.433 inches.

2. The stackable chair framework of claim 1, further comprising a seating surface and a back rest disposed on the framework.

3. The stackable chair framework of claim 2, wherein the seating surface and the back rest comprise a monolithic seating element.

4. The stackable chair framework of claim 3, wherein the seating element has a principal area defining the seating surface and the back rest, said principal area including at opposite ends thereof tab portions, one of said tab portions disposed proximate the seating surface, and one of said tab portions disposed proximate the back rest, and each tab portion being removably capturable between the framework and the principal area of the seating element to secure the seating element to the framework.

5. The stackable chair framework of claim 3, wherein the monolithic seating element has a principal area defining the seating surface and the back rest, said principal area including at opposite ends thereof tab portions, each tab portion being removably positionable between the framework and the principal area of the seating element.

6. The stackable chair framework of claim 5, wherein the monolithic seating element is fabricated from metal.

7. The stackable chair framework of claim 5, wherein the monolithic seating element is fabricated from a semi-rigid material.

8. The stackable chair framework of claim 7, wherein the monolithic seating element is fabricated from plastic.

9. The stackable chair framework of claim 1, wherein the framework substantially comprises a plurality of sub-frames, each sub-frame fabricated from at least one metal rod having a maximum diameter of from approximately $5/16^{th}$ inches to less than 0.433 inches.

10. The stackable chair framework of claim 9, wherein each of the plurality of sub-frames is fabricated from a single metal rod having a maximum diameter of from approximately $5/16^{th}$ inches to less than 0.433 inches.

11. The stackable chair framework of claim 1, wherein the plurality of metal rods each have a maximum diameter of approximately $5/16^{th}$ inches.

12. A stackable chair adapted for vertical stacking in closely conforming relation with at least one other chair of identical configuration, the stackable chair comprising:

a framework dimensioned for a human being, the framework defining legs, a back rest support, and a seating surface support, the framework at least substantially comprising one or more individual frame elements each having a maximum thickness of less than 0.433 inches;

a seating surface and a back rest disposed on the framework;

wherein further the one or more individual frame elements of the framework are configured so that the framework is characterized by a stacking thickness of less than 0.433 inches; and wherein the seating surface and the back rest comprise a monolithic seating element having a principal area defining the seating surface and the back rest, and further includes at opposite ends thereof tab portions, each tab portion being removably positionable between the framework and the principal area of the seating element.

13. The stackable chair of claim 12, wherein the monolithic seating element is fabricated from metal.

14. The stackable chair of claim 12, wherein the monolithic seating element is fabricated from a semi-rigid material.

15. The stackable chair of claim 14, wherein the monolithic seating element is fabricated from plastic.

16. The stackable chair of claim 12, wherein the framework consists essentially of a plurality of metal rods each having a maximum diameter of from approximately $5/16^{th}$ inches to less than 0.433 inches.

17. The stackable chair of claim 16, wherein the framework comprises a plurality of sub-frames each fabricated from at least one metal rod, the plurality of metal rods forming said plurality of sub-frames each having a maximum diameter of from approximately $5/16^{th}$ inches to less than 0.433 inches.

18. The stackable chair of claim 17, wherein the plurality of sub-frames are each fabricated from a single metal rod having a maximum diameter of from approximately $5/16^{th}$ inches to less than 0.433 inches.

19. A stackable chair adapted for vertical stacking in closely conforming relation with at least one other chair of identical configuration, the stackable chair comprising:

a framework dimensioned for a human being, the framework defining legs, a back rest support, and a seating surface support, the framework consisting essentially of a plurality of metal rods each having a maximum diameter of from approximately $5/16^{th}$ inches to less than 0.433 inches;

a seating surface and a back rest disposed on the framework; and wherein further one or more individual frame elements of the framework are configured so that the framework is characterized by a stacking thickness of less than 0.433 inches.

20. The stackable chair of claim 19, wherein the plurality of metal rods define a plurality of sub-frames each fabricated from at least one of the said plurality of metal rods.

21. The stackable chair of claim 20, wherein the plurality of sub-frames are each fabricated from a single one of the said plurality of metal rods.

22. A stackable chair adapted for vertical stacking in closely conforming relation with at least one other chair of identical configuration, the stackable chair comprising:

a framework dimensioned for a human being, the framework defining legs, a back rest support, and a seating surface support, the framework at least substantially comprising one or more individual frame elements each having a maximum diameter of approximately $5/16^{th}$ inches;

a seating surface and a back rest disposed on the framework; and wherein further the one or more individual frame elements of the framework are configured so that the framework is characterized by a stacking thickness of less than 0.433 inches.

23. The stackable chair of claim 22, wherein the seating element has a principal area defining the seating surface and the back rest, said principal area including at opposite ends thereof tab portions, one of said tab portions disposed proximate the seating surface, and one of said tab portions disposed proximate the back rest, and each tab portion being removably capturable between the framework and the principal area of the seating element to secure the seating element to the framework.

24. A stackable chair adapted for vertical stacking in closely conforming relation with at least one other chair of identical configuration, the stackable chair comprising:

a framework dimensioned for a human being, the framework defining legs, a back rest support, and a seating surface support, the framework at least substantially comprising one or more individual frame elements each having a maximum diameter of less than 0.433 inches;

a seating surface and a back rest disposed on the framework;

wherein further the one or more individual frame elements of the framework are configured so that the framework is characterized by a stacking thickness of less than 0.433 inches; and wherein the seating surface and the back rest comprise a monolithic seating element having a principal area defining the seating surface and the back rest, said principal area including at opposite ends thereof tab portions, one of said tab portions disposed proximate the seating surface, and one of said tab portions disposed proximate the back rest, and each tab portion being removably capturable between the framework and the principal area of the seating element to secure the seating element to the framework.

* * * * *